US007389884B2

(12) United States Patent
Stravitz

(10) Patent No.: US 7,389,884 B2
(45) Date of Patent: Jun. 24, 2008

(54) MULTI-SECTION RETAINING/SORTING/BROWSING APPARATUS

(76) Inventor: David M. Stravitz, 16 Park Ave. - Suite 14A, New York, NY (US) 10016

( * ) Notice: Subject to any disclaimer, the term of this patent is extended or adjusted under 35 U.S.C. 154(b) by 583 days.

(21) Appl. No.: 11/040,806

(22) Filed: Jan. 21, 2005

(65) Prior Publication Data

US 2005/0133468 A1 Jun. 23, 2005

Related U.S. Application Data

(63) Continuation-in-part of application No. 10/702,205, filed on Nov. 4, 2003, now Pat. No. 7,086,538.

(51) Int. Cl.
*B42F 17/00* (2006.01)
*A47F 5/00* (2006.01)

(52) U.S. Cl. ..... 211/11; 169/184

(58) Field of Classification Search ..... 211/10, 211/11, 50, 53, 58, 184, 169, 171, 99, 169.1, 211/165, 126.13, 40; 108/60, 61; 206/371
See application file for complete search history.

(56) References Cited

U.S. PATENT DOCUMENTS

| | | | | |
|---|---|---|---|---|
| 744,350 | A | 11/1903 | Jewell | |
| 750,350 | A | 1/1904 | Denson | |
| 807,084 | A | 12/1905 | Muller | |
| 1,106,265 | A | 8/1914 | Whittle | |
| 1,119,925 | A | 12/1914 | Chatham | |
| 1,440,491 | A | 1/1923 | Proudfit | |
| 1,692,231 | A * | 11/1928 | Thompson | 220/550 |
| 1,736,574 | A | 11/1929 | Squire | |
| 1,764,128 | A | 6/1930 | Straubel | |
| 2,047,097 | A | 7/1936 | Dunbar | |
| D148,076 | S | 12/1947 | Keesing, Jr. | |
| 2,459,385 | A | 1/1949 | Martin | |
| 2,581,730 | A | 1/1952 | Talmage | |
| 3,358,692 | A | 12/1967 | Proulx | |
| 3,446,360 | A | 5/1969 | Gutierrez | |
| 3,554,381 | A | 1/1971 | Guest | |
| D231,137 | S | 4/1974 | Jublin | |
| 3,812,975 | A | 5/1974 | Gutierrez | |
| 3,869,045 | A | 3/1975 | Lear | |
| 3,966,050 | A | 6/1976 | Dahl | |
| 4,084,699 | A | 4/1978 | Koepke | |
| 4,426,007 | A | 1/1984 | Beleckis | |
| 4,512,480 | A | 4/1985 | Evenson | |
| 4,629,067 | A | 12/1986 | Pavlik et al. | |
| 5,215,198 | A | 6/1993 | Sutton | |

(Continued)

*Primary Examiner*—Jennifer E. Novosad
(74) *Attorney, Agent, or Firm*—Frishauf, Holtz, Goodman & Chick, P.C.

(57) ABSTRACT

Multi-section retaining/sorting/browsing apparatus including a base including a plurality of parallel slots and a plurality of dividers each arranged in connection with a respective slot. Adjacent dividers define object-retaining sections therebetween. Each divider has a pair of separated anchor portions and an object support portion coupled to the anchor portions and extending through a respective slot to provide a support for retaining objects. The anchor portions are rotatably retained in connection with the base to enable the dividers to be flipped forward and backward in a longitudinal direction. When file folders or other objects are retained in the object-retaining sections, it becomes possible to sort papers, documents or files in the sections and to browse through the contents of a file folder without removing them from the apparatus.

20 Claims, 8 Drawing Sheets

U.S. PATENT DOCUMENTS

| | | | | | |
|---|---|---|---|---|---|
| D353,158 | S | | 12/1994 | Evenson | |
| D388,121 | S | | 12/1997 | Gomez | |
| D400,587 | S | * | 11/1998 | Stravitz | D19/75 |
| 6,065,610 | A | | 5/2000 | Elmore | |
| D432,578 | S | | 10/2000 | Stravitz | |
| D440,809 | S | | 4/2001 | Hunt | |
| 6,227,384 | B1 | | 5/2001 | Saylor et al. | |
| D500,803 | S | | 1/2005 | Stravitz | |
| D502,220 | S | | 2/2005 | Stravitz | |
| D504,702 | S | | 5/2005 | Stravitz | |
| 7,086,538 | B2 | * | 8/2006 | Stravitz | 211/11 |
| 2004/0065629 | A1 | * | 4/2004 | Hunt et al. | 211/40 |

* cited by examiner

MULTI-SECTION RETAINING/SORTING/BROWSING APPARATUS

CROSS-REFERENCE TO RELATED APPLICATION

This application is a continuation-in-part of U.S. patent application Ser. No. 10/702,205 filed Nov. 4, 2003 now U.S. Pat. No. 7,806,538, the specification of which is incorporated by reference herein.

FIELD OF THE INVENTION

The present invention relates to an apparatus which defines a plurality of retaining sections each of which is capable of receiving various objects and which enables easy sorting of objects as well as browsing of the objects received in the retaining sections.

BACKGROUND OF THE INVENTION

In an office setting, a common situation arises in which papers or documents must be retained and/or sorted. For example, it might be required to create ten different booklets with each booklet having twenty sequentially numbered pages. If the twenty pages are printed one at a time in batches of ten (one for each booklet), then they will have to be sorted with one page being allotted to each booklet.

A multi-section retaining/sorting/browsing apparatus is often used for this purpose and includes a plurality of dividers which define object-retaining sections therebetween into which the pages can be placed sequentially. That is, first the page numbered 1 is placed in each section, then the page numbered 2 is placed behind page number 1 in each section, and so on until ten complete booklets are created. When placing a page in each section, the dividers may be flipped to expose that section and after the page is placed in that section, a divider may be flipped to expose an adjacent section. The sorting process continues in this manner by flipping the dividers and inserting pages into each exposed section. Alternatively, sorting can be done in reverse, starting with the last page. Using this technique, flipping of the dividers may be avoided.

Such multi-section retaining/sorting/browsing apparatus are also used to hold file folders to enable papers to be stored and/or sorted into the file folders. In this case, a file folder can be retained in each section and opened one at a time by flipping the dividers (without removing the file folder) and one or more pages or documents may be placed into each file folder as it is opened.

The same apparatus also enables browsing through the file folders retained in the apparatus. For example, by flipping the dividers to expose the file folders in each section, it is possible to view the contents of each file folder without removing the file folders from the apparatus. By placing the file folders in the sections defined by the apparatus, it is not required to remove the file folders to open each one but rather, the file folders can be continually retained in the sections in the apparatus and by flipping the dividers, each file folder can be opened and browsing of the contents thereof is possible.

A problem with the conventional multi-section retaining/sorting/browsing apparatus of this type is that not all of the known devices allow for a file folder in a particular section to be opened without requiring the exertion of pressure to keep the dividers in place and that section exposed.

A multi-section retaining/sorting/browsing apparatus is often also used to display small objects for sale, wherein it is desired to ease the purchaser's ability to browse through the objects. In particular in the sale of multi-media objects, such as CDs, DVDs, records and computer software, it is desirable to enable a purchaser to relatively easily and quickly flip through the objects to see whether any are of interest for possible purchase. To this end, by providing a retaining/sorting/browsing apparatus including a plurality of dividers which define object-retaining sections therebetween into which the multi-media objects are placed, the purchaser can easily flip the dividers, or the objects depending on which is larger, forward or backward to view the objects in each section. If the objects are larger and thus flipped, then the dividers are flipped upon flipping of the objects.

Unfortunately, retaining/sorting/browsing devices are not always designed so that easy flipping is provided in combination with the ability to allow the user or purchaser to expose an object or objects in one or more of the object-retaining sections without exerting pressure to keep the dividers in position so that the desired section is exposed.

OBJECTS AND SUMMARY OF THE INVENTION

Accordingly, it is an object of the invention to provide a new and improved multi-section retaining/sorting/browsing apparatus.

It is another object of the present invention to provide a new and improved multi-section retaining/sorting/browsing apparatus including a plurality of object-retaining sections and which is designed to facilitate easy sorting of objects into each section.

It is still another object of the present invention to provide a new and improved multi-section retaining/sorting/browsing apparatus including a plurality of object-retaining sections and which enables exposure and viewing of an object or objects such as file folders in one or more of the object-retaining sections preferably without exerting pressure to keep the dividers in place and that section exposed.

It is yet another of the present invention to provide a new and improved multi-section retaining/sorting/browsing apparatus which is easy to assemble.

In order to achieve these objects and others, a multi-section retaining/sorting/browsing apparatus in accordance with the invention includes a base including a plurality of parallel slots and a plurality of dividers each arranged in connection with a respective slot. Adjacent dividers define object-retaining sections therebetween. Each divider has a pair of separated anchor portions and an object support portion coupled to the anchor portions and extending through a respective slot to provide a support for retaining objects. The anchor portions are rotatably retained in connection with the base to enable the dividers to be flipped forward and backward in a longitudinal direction.

With such an apparatus, it becomes possible to place file folders in each section to enable sorting of papers or documents into the file folders in the sections and browse through the file folders without removing them from the apparatus.

One construction to maintain the anchor portions in connection with the base is to provide each anchor portion with a projection extending outwardly to a position below an overlying portion of the base. The projections are thereby supported and rotate on bearing surfaces defined by the base. Additional bearing surfaces may be provided on the base to sandwich or surround the projections.

The base may be made of two parts, an upper member and a lower member, with the anchor portions being partially retained therebetween. The upper member may include a top wall defining an opening through which the object support portions of the dividers extend and transversely extending flanges and longitudinally extending flanges projecting downward from the top wall alongside the opening. The longitudinally extending flanges define end walls of the slots, each end wall including a curved indentation. A respective anchor portion passes through each curved indentation to be situated below an overlying portion of the top wall. The lower member may include a substantially planar portion and a plurality of support projections arranged on an upper surface thereof. The support projections define the bearing surfaces on which the projections of the anchor portions are supported and rotate.

To define the slots in the large opening defined by the top wall of the upper member of the base, the lower wall includes transversely extending elevated sections, each including an elevated horizontal wall. The horizontal walls partition the opening defined by the upper member into slots and limit the flipping of the dividers in the longitudinal direction.

To connect the upper and lower members together, ramps extend inward from the longitudinally extending flanges of the upper member and lips extending downward from transverse ends of the horizontal walls of the elevated sections of the lower member. When the base is assembled, the lips are urged along angled surface of the ramps to pass over the ramps and thereby connect the upper member and the lower member together.

BRIEF DESCRIPTION OF THE DRAWINGS

The invention, together with further objects and advantages thereof, may best be understood by reference to the following description taken in conjunction with the accompanying drawings, wherein like reference numerals identify like elements.

DETAILED DESCRIPTION OF THE INVENTION

Figure 1:
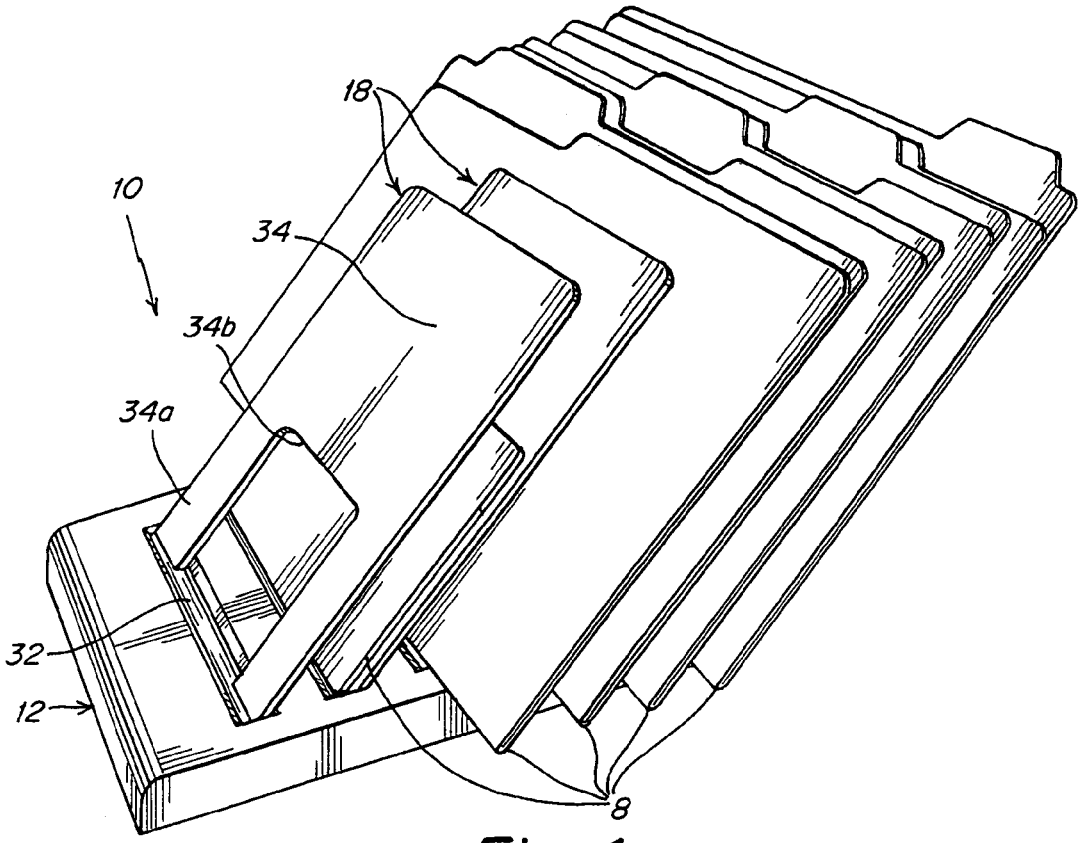
FIG. 1 is a perspective view of a multi-section retaining/sorting/browsing apparatus in accordance with the invention in use while retaining file folders and a media storage package.

Referring to the accompanying drawings wherein like reference numerals refer to the same or similar elements, a multi-section retaining/sorting/browsing apparatus in accordance with the invention is designated generally as 10 and comprises a base 12 defining one or more cavities 14 (see FIG. 4A) and including a plurality of parallel slots 16. The apparatus 10 also includes dividers 18 arranged in connection with the slots 16 in the base 12 and extending at least partially into the cavity(ies) 14. The dividers 18 define object-retaining sections 20 therebetween, i.e., one object-retaining section 20 is defined between each adjacent pair of dividers 18 (see FIG. 2). Objects 8, such as file folders or the like, are shown in the object-retaining sections 20.

To establish a convention for the following description and without limiting the invention, in the embodiment shown in FIGS. 1-6 and 8, all of the slots 16 extends in a transverse direction of the base 12 and the slots 16 are therefore arranged alongside and substantially parallel to one another in a longitudinal direction of the base 12.

In some embodiments, a single cavity 14 is provided in the base 12, in which case, all of the slots 16 communicate with the single cavity 14 and a portion of each divider 18 is situated in the single cavity 14. On the other hand, if a plurality of cavities 14 are provided in the base 12 (see FIG. 4B), each slot 16 can be arranged to communicate with a respective cavity 14, i.e., there are an equal number of cavities 14 and slots 16. Nevertheless, it is also possible to have multiple cavities 14 with each cavity 14 communicating with a plurality of slots 16.

All of the slots 16 may have the same size for receiving dividers 18 having the same length as shown in FIG. 1. In this case, a single cavity 14 can be formed in the base 12. However, if it is desired to provide two or more sets of dividers with each set having a different length, then two or more cavities can be formed in the base, with each cavity having a length in a transverse direction designed to accommodate a respective set of dividers.

The base 12 may be formed from two members, an upper member 22 defining a top wall 24 of the cavity or cavities 14 and a lower member 26 (see FIG. 3A) defining a bottom wall 28 of the cavity or cavities 14. The upper member 22 may include an opening in a bottom surface 22*a* into which the lower member 26 is positioned and then either permanently or removably attached to the upper member 22. A permanent form of connection for the upper and lower members 22, 26 may be provided by an adhesive such as glue or fastener members such as nails, screws and the like. A removable form of connection for the upper and lower members 22, 26 may be provided by a releasable locking member shown in FIG. 5, e.g., a projection 40 formed on the lower member 26 which engages with a recess 42 formed on the upper member 22" whereby the portion of the upper member 22" including the recess 42 is slightly flexible to enable outward flexing thereof and removal of the lower member 26" from engagement with the upper member 22".

Figure 3A:
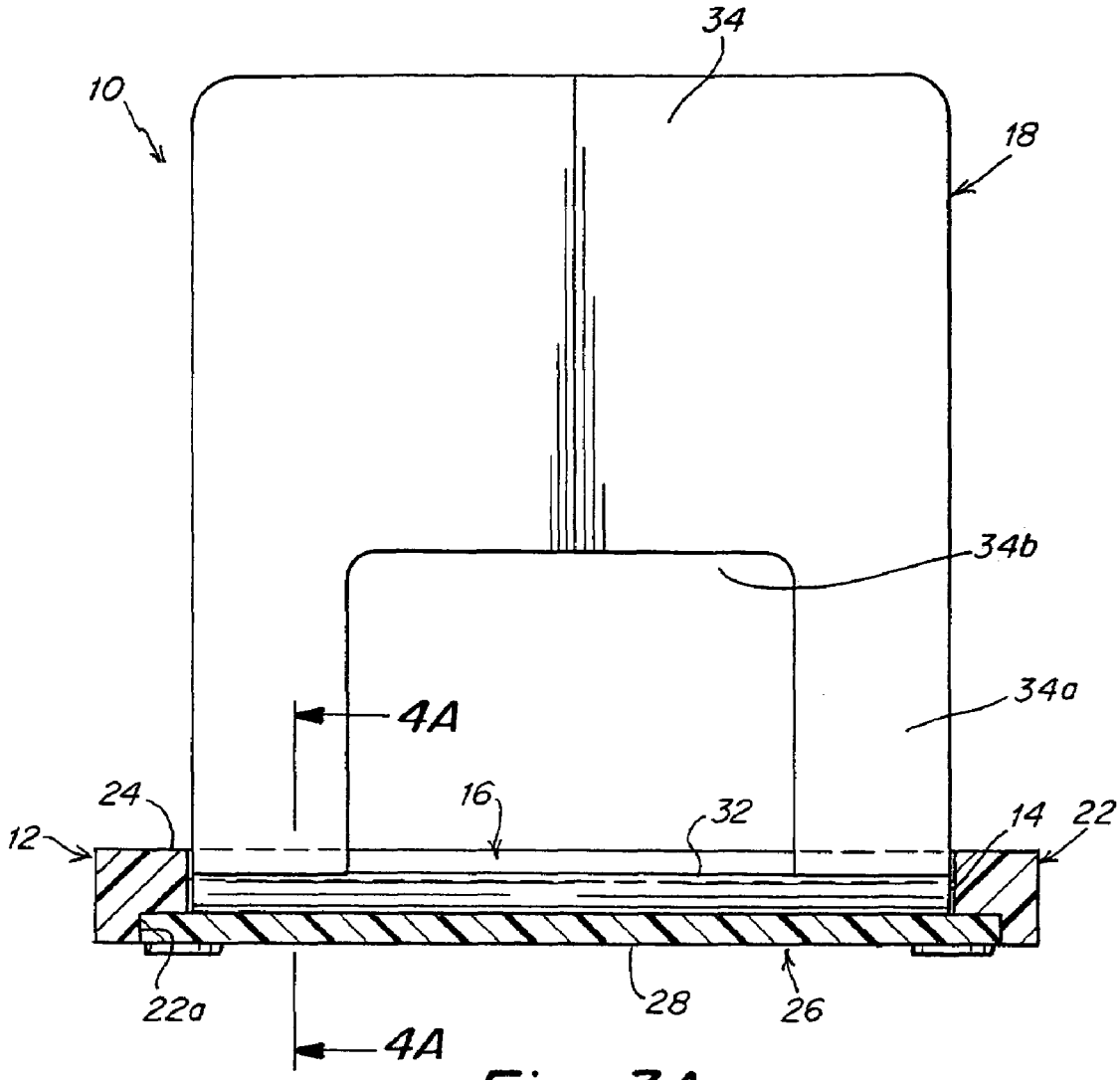
FIG. 3A is a cross-sectional view taken along the line 3-3 in FIG. 2 of the multi-section retaining/sorting/browsing apparatus in accordance with the invention shown in FIG. 1.
Figure 4A:
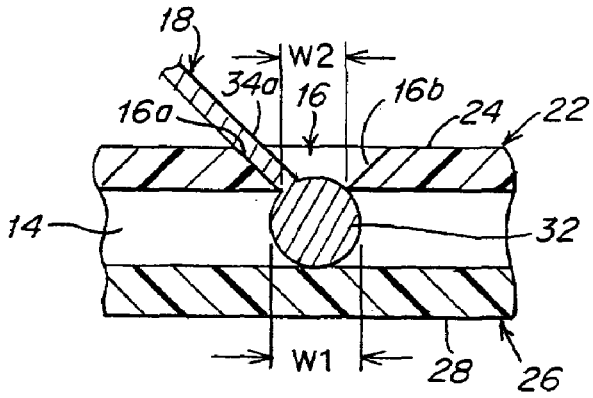
FIG. 4A is a cross-sectional view taken along the line 4A-4A in FIG. 3A of the multi-section retaining/sorting/browsing apparatus in accordance with the invention shown in FIG. 1.

Referring now to FIGS. 3A and 4A, in a first embodiment of the invention, a single cavity 14 is provided and the plurality of slots 16 all communicate with this cavity 14. The slots 16 are arranged in the top wall 24 of the upper member 12 and have substantially the same transverse length as the cavity 14.

Figure 2:
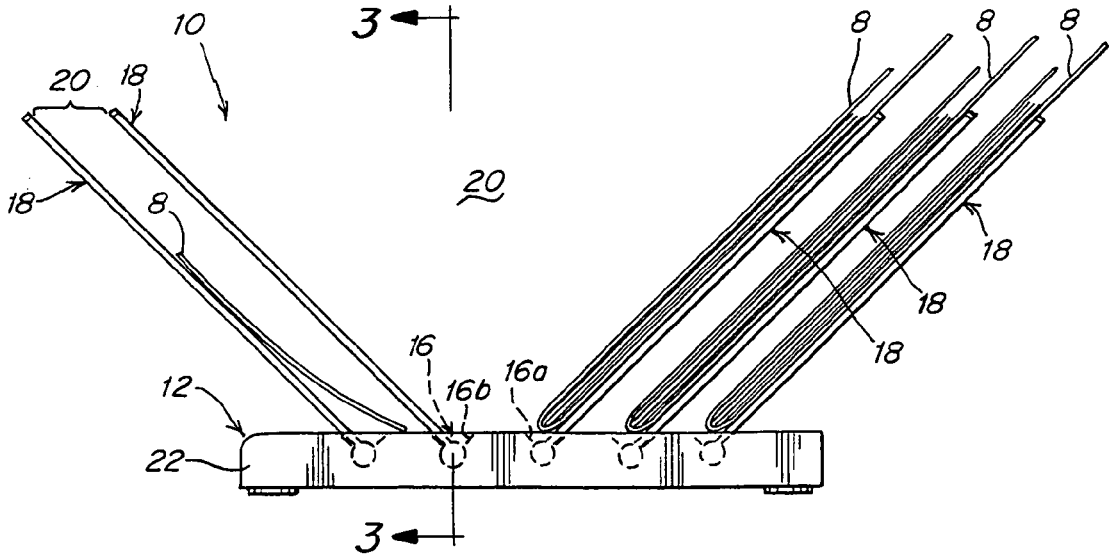
FIG. 2 is a side view of the multi-section retaining/sorting/browsing apparatus shown in FIG. 1

Each divider 18 has an anchor portion 32 arranged in the cavity 14 and an object support portion 34 coupled to the anchor portion 32 and extending through a respective slot 16 to provide a support for retaining the objects 8 (see FIG. 2). To retain the dividers 18 in the base 12, the anchor portion 32 has a larger width W1 (the diameter when the anchor portion is cylindrical) than the smallest width W2 of the slot 16 (W1>W2) so that the anchor portion 32 cannot pass through the slot 16 once placed in the cavity 14 during assembly of the apparatus 10 (described below).

To enable a limited amount of flipping of the dividers 18 during use of the apparatus 10, each slot 16 is preferably defined by downwardly angled surfaces 16*a*,16*b* of the top wall 24 of the base 12. As such, a smaller opening is formed in a lower surface of the top wall 24 than in an upper surface of the top wall 24 for each slot 16 (see FIG. 4A). The dividers 18 are thus rotatable over an angular range defined by the angled surfaces 16*a*,16*b*.

The anchor portion 32 is rotatable in the cavity 14 to enable the divider 18 to be flipped forward and backward in a longitudinal direction (see FIG. 2) wherein two dividers 18 are shown having been flipped forward whereas three dividers 18 are shown having been flipped backward in which case, an object-retaining section 20 between the second and third dividers 18 is exposed). When flipped forward, the divider 18 will rest against the rearward facing angled surface 16*a* and when flipped rearward, the divider 18 will rest against the forward facing angled surface 16*b*.

To enable passage of the object support portion 34 through the respective slot 16, a part 34*a* of the object support portion 34 has a length in the transverse direction equal to or less than the length of the respective slot 16. The object support portions 34 may be substantially planar and directly connected to the anchor portions 32. Also, the object support portions 34 may be provided with different forms or shapes as desired, e.g., with a recess 34*b* as shown, and from different materials (i.e., metal, plastics, wood, etc).

To assemble the apparatus 10, the upper and lower members 22, 26 and dividers 18 are first constructed and the dividers 18 are inserted through the slots 16 by inserting the object support portions 34 of the dividers 18 through the slots 16 until the anchor portions 32 come into contact with the lower surface of the top wall 24 of the upper member 22. Then, the lower member 26 is inserted into the opening 22*a* in the upper member 22 and attached to the upper member 22. The apparatus is thus ready for use for retaining objects, for enabling sorting of objects such as papers and documents, and for enabling browsing of objects such as file folders.

Figure 3B:
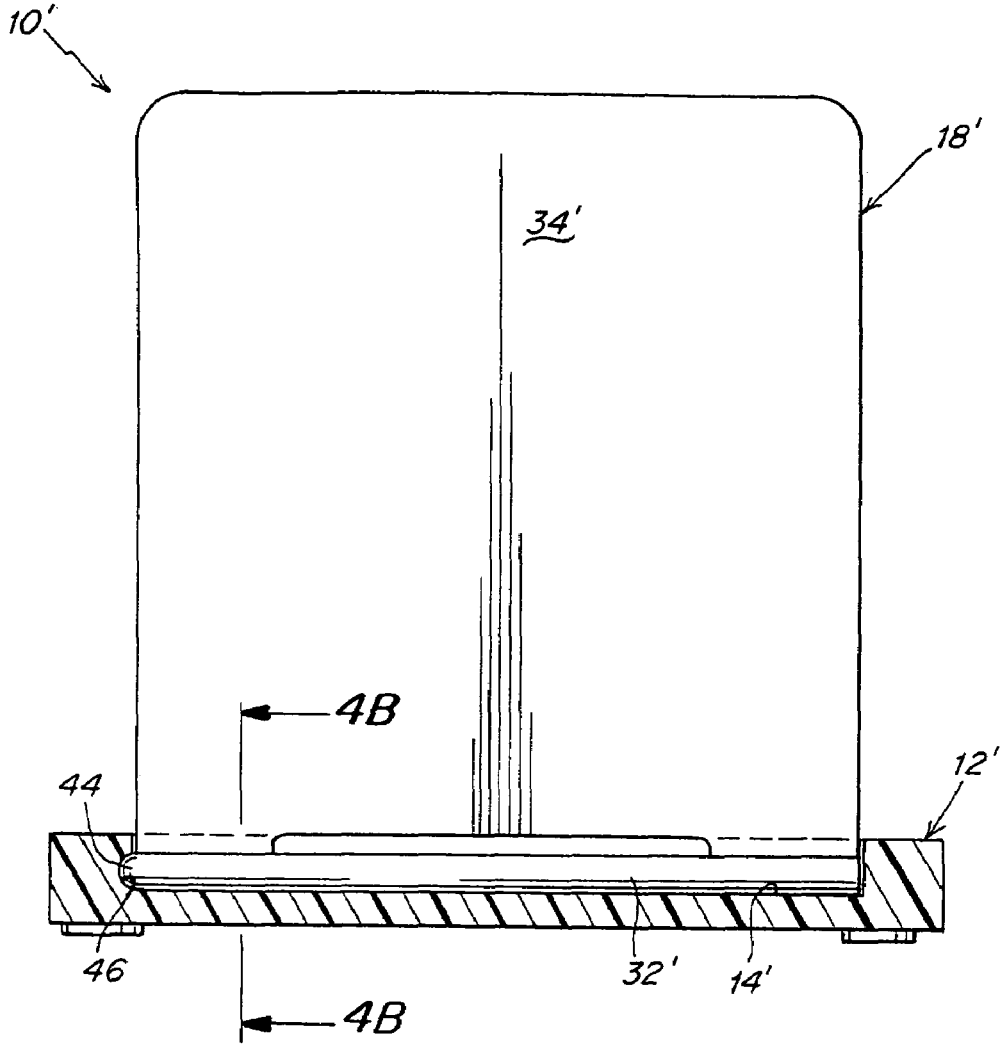
FIG. 3B is a cross-sectional view taken along the line 3-3 in FIG. 2 of another embodiment of a multi-section retaining/sorting/browsing apparatus in accordance with the invention.
Figure 4B:
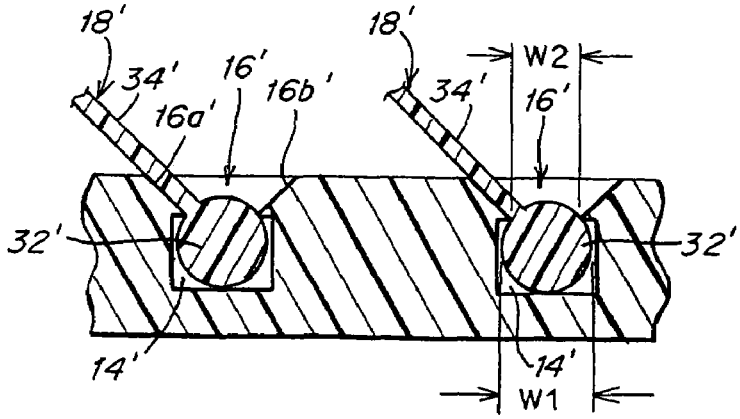
FIG. 4B is a cross-sectional view taken along the line 4B-4B in FIG. 3B.

Referring now to FIGS. 3B and 4B, another embodiment of the multi-section retaining/sorting/browsing apparatus in accordance with the invention (designated 10') includes a base 12' which has a unitary construction formed with a plurality of cavities 14' and parallel slots 16', each slot 16' communicating with a respective one of the cavities 14' (although it is also possible to form a single cavity in the base 12' communicating with a plurality of or all of the slots 16' as described above).

Dividers 18' are retained in the cavity 14' by virtue of the anchor portion 32' having a width W1 (the diameter of the anchor portion since the anchor portion 32 is cylindrical) larger than the width W2 of the slots 16' (see FIG. 4B). As such, the anchor portion 32' cannot pass upwardly through the slot 16'.

Since the base 12' has a unitary construction, the assembly method described above cannot be used for this embodiment. In this embodiment therefore, in order to place the dividers 18' into the slots 16' in the assembly of the apparatus 10', the anchor portion 32' of the dividers 18' (and possibly also the object support portion 34') are formed from a material which provides a small degree of resiliency, such as some types of molded plastics, so that the anchor portions 32' of the dividers 18' can be pressed (i.e., forced) downwardly along the inclined surfaces 16*a*', 16*b*' into the slots 16'.

Optionally, as shown in FIG. 3B, one or both transverse ends of the anchor portion 32' may include a projection 44 which is engaged with a recess 46 in an inner wall defining the cavity 14' to more securely retain the dividers 18' in the slots 16'. One or both of the transverse ends of the anchor portion could also be provided with a recess while the inner wall of the cavity 14' is provided with a complementary projection.

Assembly of the apparatus 10' would therefore entail simply pressing each divider 18' into a respective slot 16', and so that the projection on the divider 18's enters into the recess 46 in the inner wall of the base 12' defining the cavity 14' if present.

Figure 3C:
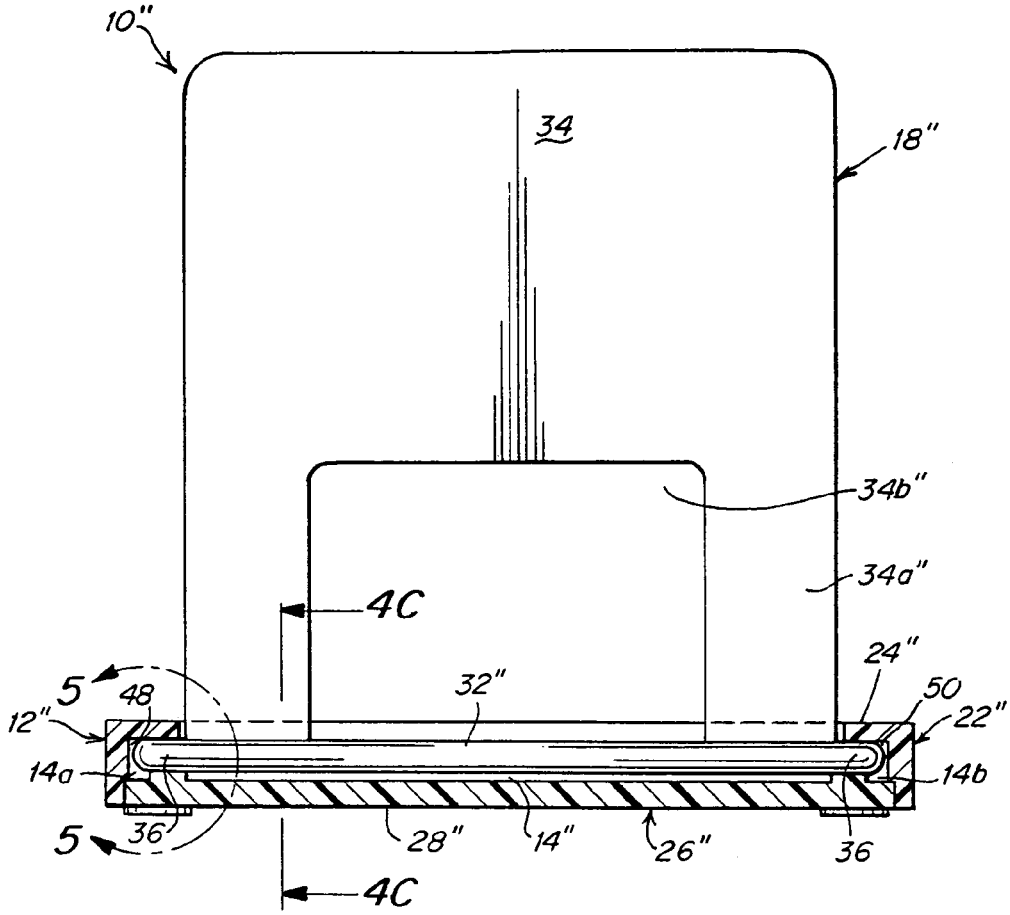
FIG. 3C is a cross-sectional view taken along the line 3-3 in FIG. 2 of still another embodiment of a multi-section retaining/sorting/browsing apparatus in accordance with the invention.
Figure 4C:
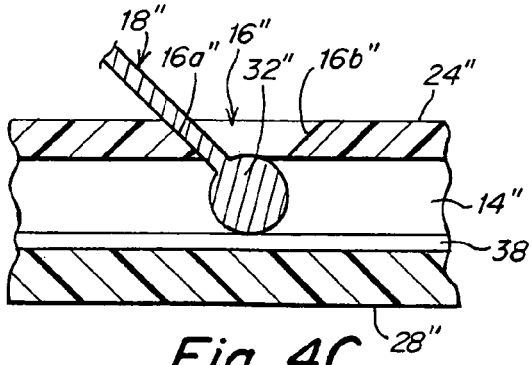
FIG. 4C is a cross-sectional view taken along the line 4C-4C in FIG. 3C.
Figure 5:
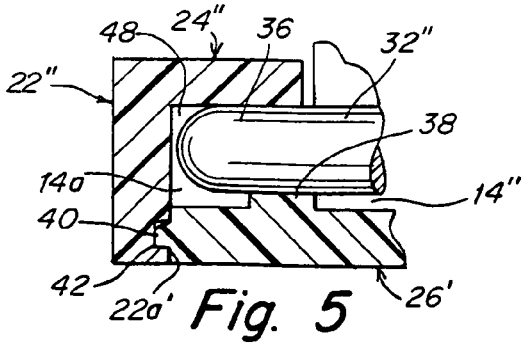
FIG. 5 is an enlarged view of the area encircled by arrows 5-5 in FIG. 3C.
Figure 6:
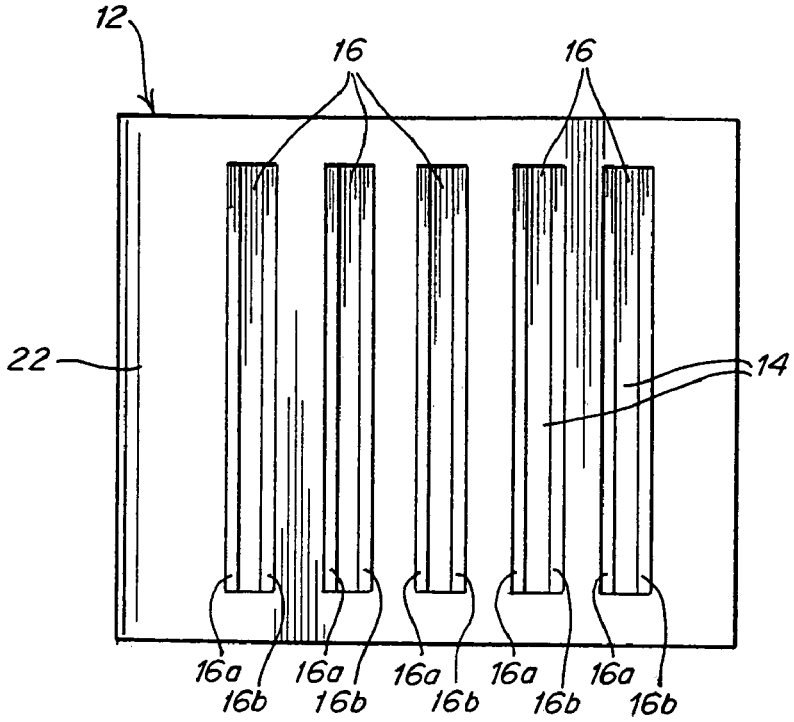
FIG. 6 is a top view of a base of the multi-section retaining/sorting/browsing apparatus in accordance with the invention shown in FIG. 1.

Referring now to FIGS. 3C, 4C and 5, another embodiment of the multi-section retaining/sorting/browsing apparatus in accordance with the invention (designated 10") includes a base 12" defining a single cavity 14" and a plurality of slots 16" all communicating with the cavity 14". The base 12" is comprised of an upper member 22" and a lower member 26". The apparatus 10" may have the same features of the embodiment described in FIGS. 3A and 4A unless otherwise noted or inconsistent with the following description and the same elements are now followed by the notation (").

Retention of the dividers 18" in connection with the base 12" is provided by constructing the anchor portion 32" of the dividers 18" to have a larger transverse length than the transverse length of the slots 16", and specifically, to extend beyond each transverse end of the slots 16". Thus, the slots 16" are formed in the top wall 24" of the upper member 22" so that each slot 16" has a first transverse end 48 spaced inward from an adjacent end 14*a* of the cavity 14" and a second transverse end 50 spaced inward from an adjacent end 14*b* of the cavity 14" (see FIGS. 3C and 5). An overhanging portion of the top wall 24" is thus arranged above the cavity 14" alongside each of the slots 16". The anchor portion 32" of each divider 18" includes a projection 36 at each transverse end which is situated below the overhanging portion of the top wall 24".

The projections 36 are secured in the base 12" between the top wall 24" and the bottom wall 28" to enable rotation of the anchor portion 32" and thus the divider 18". To this end, the projections 36 may be supported on raised shoulders 38 of the bottom wall 28" so that the projections 36 are positioned between the shoulders 38 and the overhanging portion of the top wall 24" defined by the upper member 22" (see FIGS. 3C and 4C). The anchor portion 32" of each divider 18" may be substantially cylindrical with the projections 36 being rounded in the form of bullets.

To assemble the apparatus 10", the upper and lower members 22", 26" and dividers 18" are first constructed and the dividers 18" are inserted through the slots 16" by inserting the object support portions 34" of the dividers 18" through the slots 16" until the anchor portions 32" come into contact with the lower surface of the top wall 24" of the upper member 22". Then, the lower member 26" is inserted into the opening in the upper member 22" and attached to the upper member 22". The apparatus is thus ready for use for retaining objects, for enabling sorting of objects such as papers and documents, and for enabling browsing of objects such as file folders. The dividers 18" may be pressed down into slots 16" as described above with reference to FIGS. 3B and 4B when the materials have sufficient resiliency.

Figure 7:
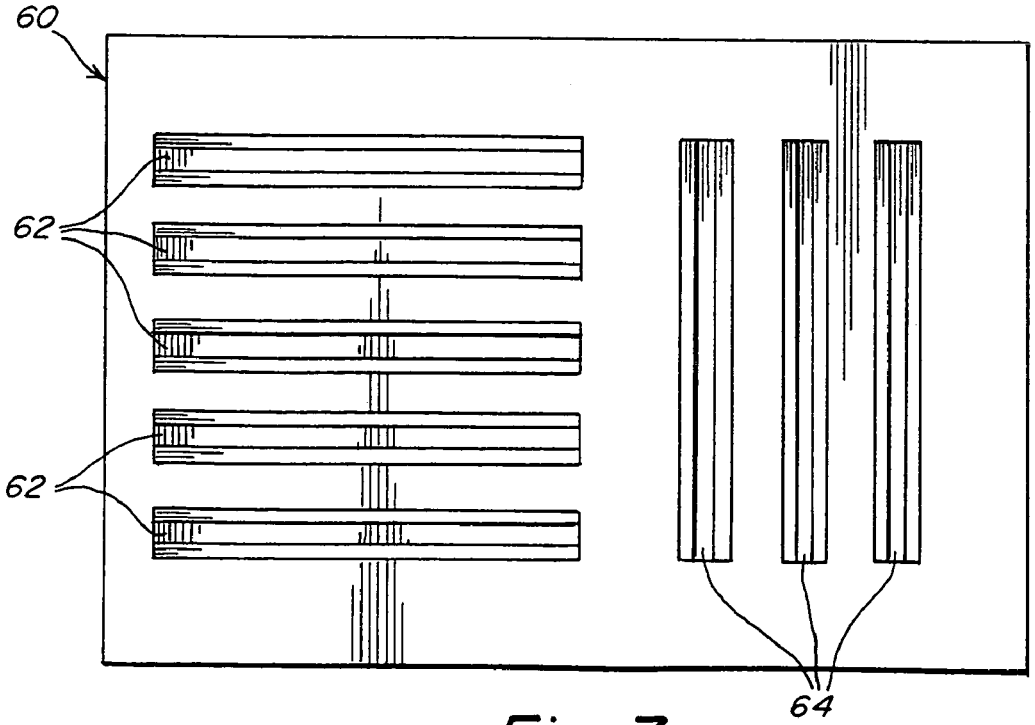
FIG. 7 is a top view of another base for a multi-section retaining/sorting/browsing apparatus in accordance with the invention.

As shown in FIG. 7, a multi-section retaining/sorting/browsing apparatus in accordance with the invention can include a base 60 which has two sets of parallel slots 62,64 oriented in different directions. The base 60 can be designed in any of the ways described above to accommodate any of the particular dividers described above. For example, the base 60 can be fabricated from two components and each slot 62,64 can be provided with a smaller width than the width of the divider to received in the slot. The same features of the embodiments shown in FIGS. 1-6 can be applied to this embodiment as well, to the extent possible.

Figure 8:
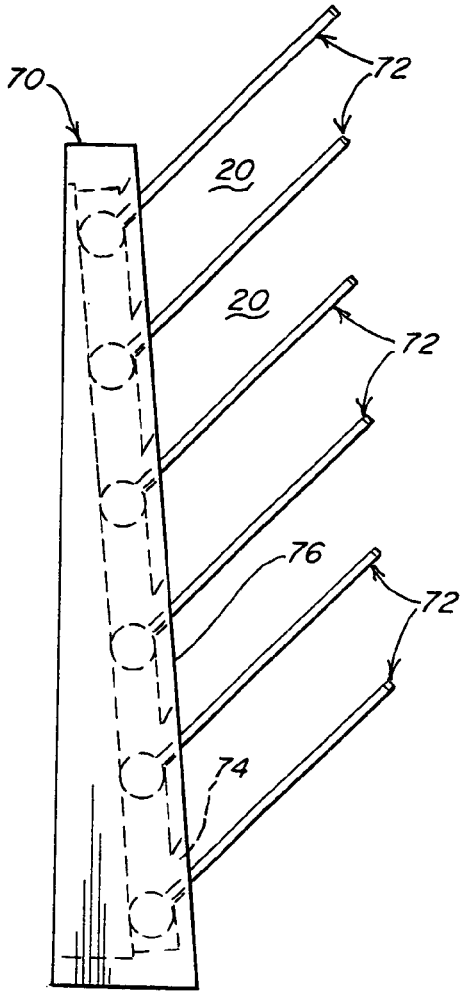
FIG. 8 is a side view of another base for a multi-section retaining/sorting/browsing apparatus in accordance with the invention.
Figure 8A:
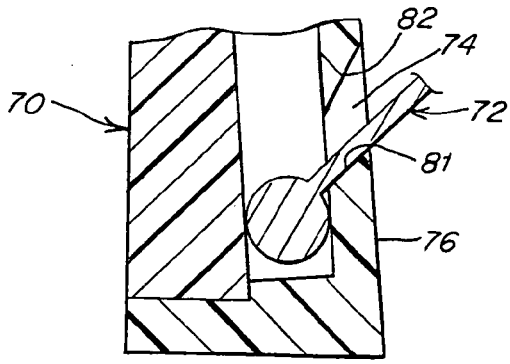
FIG. 8A is an enlarged partial sectional view of the lower portion of the embodiment of FIG. 8.

Although in the embodiments described above, the slots are formed in a top wall of the base, other forms and shapes of the base can be constructed in which the slots are formed in other walls of the base. For example, FIG. 8 shows a wall-mountable embodiment including a base 70 mountable to a wall, via appropriate mounting means such as nails, screws, adhesive and the like, and dividers 72 wherein slots 74 are formed in an angled side wall 76 of the base 70. The angled surfaces 81, 82 defining the slots 74 are formed to limit the angular orientation of the dividers 72 and therefore to enable objects to be retained in object-retaining sections 20 formed between adjacent pairs of the dividers 72. For example, as shown in FIG. 8A, lower angled surface 81 defines the lower limit to which divider 72 can travel. The lower angled surface 81 may be around 45° from the horizontal, and the upper angled surface 82 may be around 60° or more from the horizontal. Other angles, of course, could be used. Other angular orientations can be used, as desired.

Referring now to FIGS. 9, 9A, 9B, 9C and 10, another embodiment of a multi-section retaining/sorting/browsing apparatus in accordance with the invention is designated generally as 84 and comprises a base 86 including a plurality of parallel slots 88 and dividers 90 arranged in connection with the slots 88. Slots 88 extend in a transverse direction of the base 86 and are therefore arranged alongside and substantially parallel to one another in a longitudinal direction of the base 86. The dividers 90 define object-retaining sections 92 therebetween, i.e., one object-retaining section 92 is defined between each adjacent pair of dividers 90. Objects, such as file folders or the like, can be retained in the object-retaining sections 92.

Figure 9:
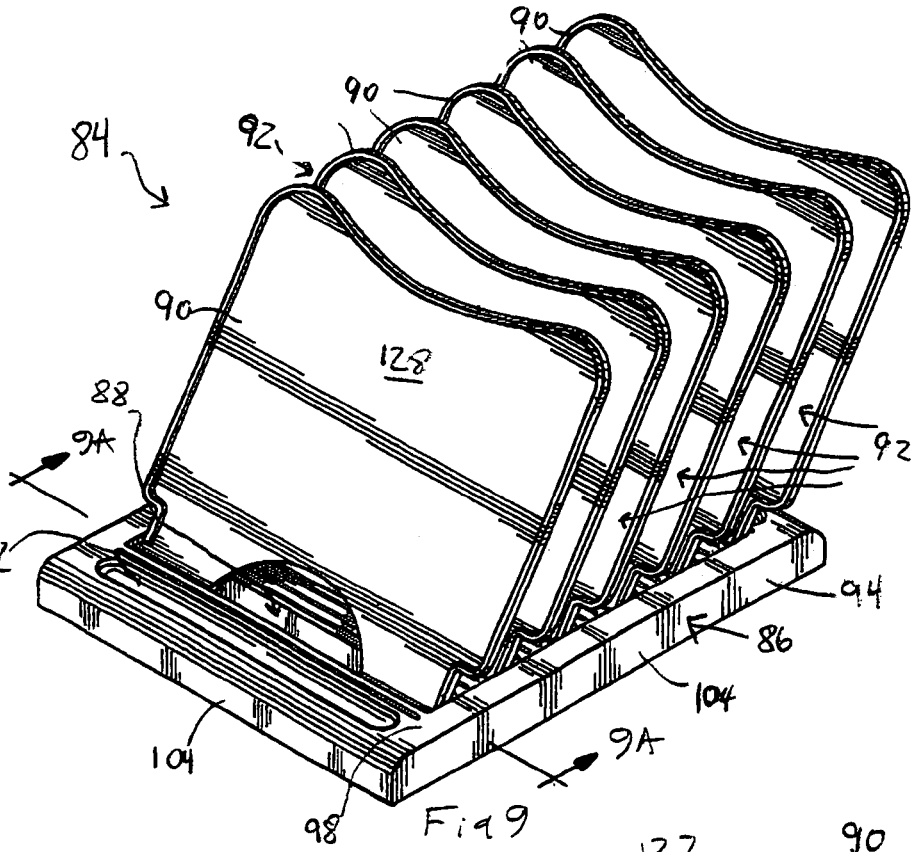
FIG. 9 is a top, front perspective view of another embodiment of a multi-section retaining/sorting/browsing apparatus in accordance with the invention.
Figure 9A:
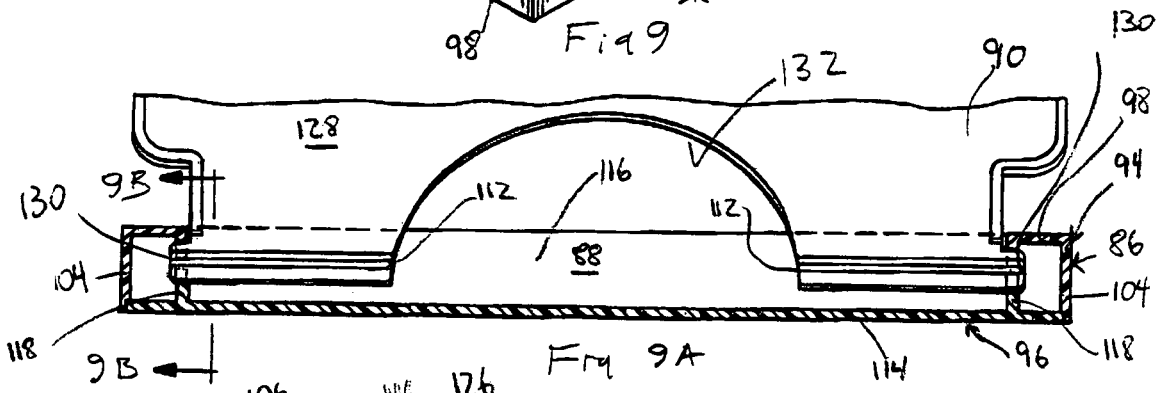
FIG. 9A is a cross-sectional view taken along the line 9A-9A in FIG. 9.
Figure 9B:
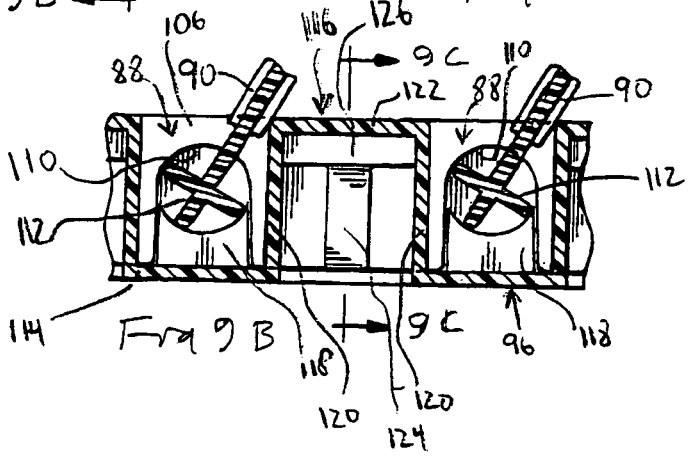
FIG. 9B is a cross-sectional view taken along the line 9B-9B in FIG. 9A.
Figure 9C:
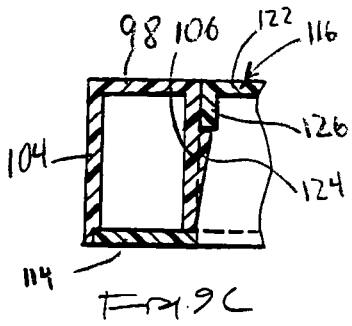
FIG. 9C is a cross-sectional view taken along the line 9C-9C in FIG. 9B.
Figure 10:
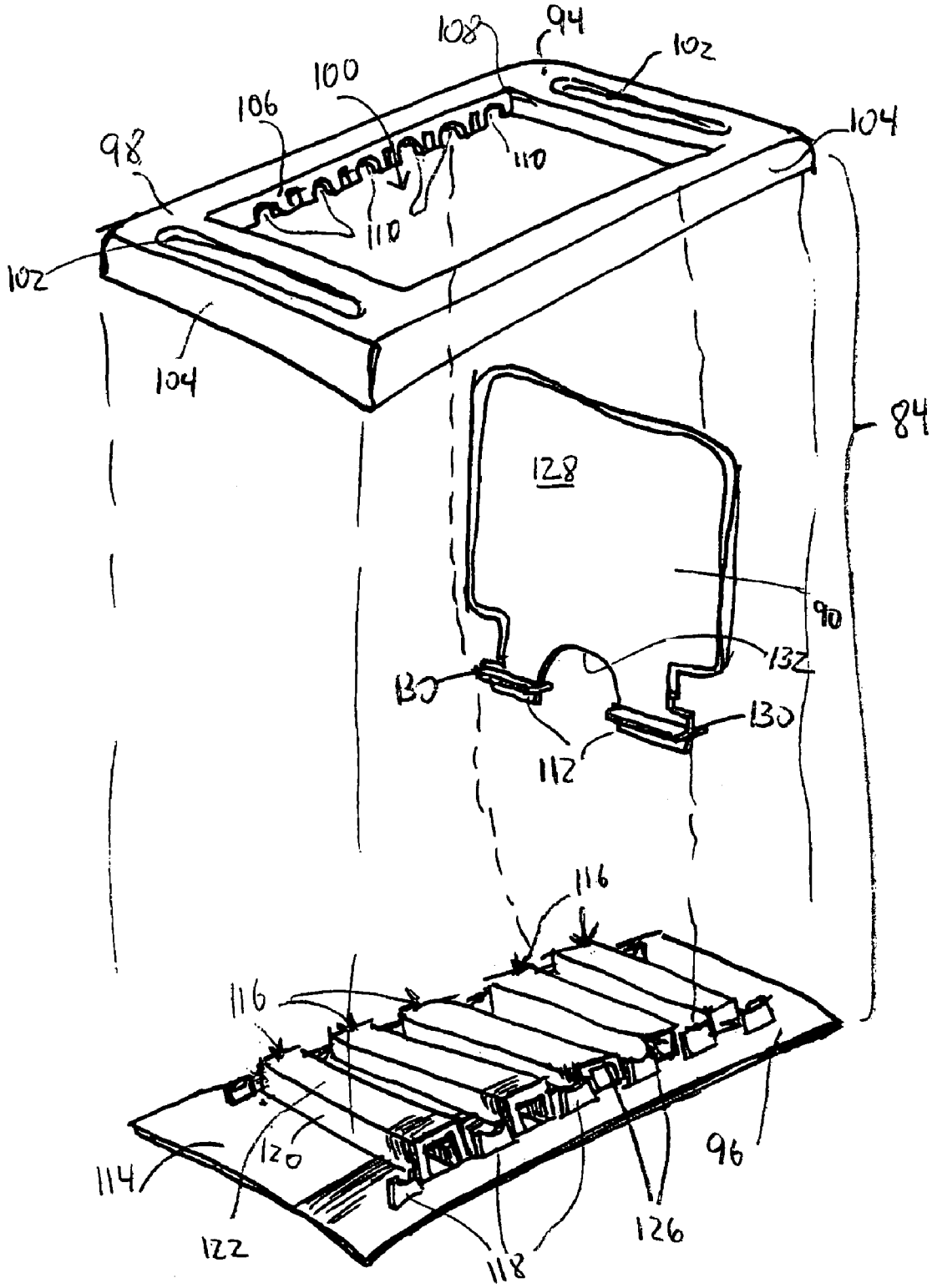
FIG. 10 is an exploded view of the multi-section retaining/sorting/browsing apparatus in accordance with the invention shown in FIG. 9.

The base 86 is formed from two separate members, an upper member 94 and a lower member 96 (see FIG. 10). Upper member 94 includes a top wall 98 defining an opening 100 and having a transversely extending receptacle 102 on each longitudinal side of the opening 100. Receptacles 102 are designed to accommodate pencils, pens or other writing implements, or paper clips, erasers and other types of office products. Upper member 94 also includes peripheral side walls 104 and transversely extending flanges 108 projecting downward from the top wall 98 alongside opening 100. Upper member 94 also includes longitudinally extending flanges 106 projecting downward from the top wall 98 alongside the opening 100. Each longitudinally extending flange 106 defines end walls of the slots 88 and includes a plurality of curved slots or indentations 110 under which part of an X-shaped anchor portion 112 of a respective divider 90 is placed (see FIG. 9B).

Lower member 96 includes a planar portion 114, a plurality of transversely extending elevated sections 116 arranged on the upper surface of the planar portion 114 and a plurality of support projections 118 arranged on the upper surface of the planar portion 114. Each elevated section 116 includes a pair of vertical walls 120 and a horizontal wall 122 raised above the planar portion 114 by the vertical walls 120. Instead of a pair of vertical walls 120, other construction for raising or elevating horizontal wall 122 above the planar portion 114 of the lower member 96 are also possible. The horizontal walls 122 of the elevated sections 116 preferably positioned to be even with the top wall 98 of the upper member 94.

Support projections 118 define a curved bearing surface on which part of the anchor portions 112 of the dividers 90 are supported and rotate (see FIG. 9B).

Slots 88 are defined, on the longitudinal sides, by a pair of vertical walls 120 or, in the case of the slots 88 at the longitudinal ends of the base 86, by one vertical wall 120 and an opposed transversely extending flange 108. As such, flipping movement of the dividers 90 arranged in connection with the slots 88 is limited by contact with the elevated sections 116, or by contact with the upper wall 98 of the upper member 94. On the transverse sides, the slots 88 are defined by part of the longitudinally extending flanges 106 and support projections 118.

The upper member 94 may include an opening in a bottom surface into which the lower member 96 is positioned and then either permanently or removably connected to the upper member 94. For example, connecting structure may be provided on the upper and lower members 94, 96 to securely connect the upper and lower members 94, 96 together. Specifically, the upper member 94 includes angled projections or ramps 124 extending inward from the longitudinally extending flanges 106 between the curved indentations 110 and the lower member 96 includes a lip 126 extending downward from the transverse ends of the horizontal wall 122 of each elevated section 116. When the base 86 is assembled, the lips 126 are urged along the angled surface of the ramps 124 until they pass the ramps 124 and are seated on a flat, upper surface of the ramps 124 (see FIGS. 9B and 9C). At this stage, the upper and lower members 94, 96 are securely attached to one another.

Instead of forming ramps 124 on the upper member and the lips 126 on the lower member 96, a permanent form of connection for the upper and lower members 94, 96 may be provided by an adhesive such as glue or fastener members such as nails, screws and the like.

Each divider 90 has a pair of anchor portions 112, each supported and rotatable on a respective support projection 118, and an object support portion 128 coupled to the anchor portions 112 and extending through the opening 100 in the upper wall 98 of the upper member 94 of the base 86. To retain the dividers 90 in connection with the base 86, the anchor portions 112 each include a projection 130 at a transverse end which rests on the support projections 118 and is situated below the curved indentations 110. The presence of opposed bearing surfaces around the projections 130, formed by the support projections 118 and curved indentations 110, maintains projections 130 between the upper and lower members 94, 96 when connected together.

The projections 130 of the anchor portions 112 of each divider 90 may have a different cross-section and form than the remaining part of the anchor portion 112, e.g., it can be rounded in the form of a bullet while the remaining part of the anchor portion 112 has the X-shaped cross-section as shown.

Dividers 90 each include an arcuate opening 132 extending from a bottom edge between the anchor portions 112 and may be flared outward as shown to provide the object support portion 128 with a greater surface area for supporting objects.

To assemble the apparatus 84, the upper and lower members 94, 96 and dividers 90 are first constructed and the dividers 90 are inserted into engagement with the upper member 94 (while the upper member 94 is held upside down). Specifically, the dividers 90 are inserted through the opening 100 in the upper member 94 while the upper member 94 is held upside down such that the object support portion 128 is below the top wall 98 of the upper member 94. In view of the flaring of the object support portions 128, this cannot be achieved by simply dropping the dividers 90 (when oriented in their final orientation in the transverse direction of the upper member 94) into engagement with the curved indentations in the longitudinally extending flanges 106. Rather, the dividers 90 must first be turned away from their final orientation and inserted through the opening 100 and then turned back to their final orientation and placed onto the curved indentations 110. Preferably, all of the dividers 90 are inserted through the opening 100 first and then the projections 130 of each divider 90 are placed onto a pair of aligning curved indentations 110.

Once the dividers 90 are resting on the curved indentations 110, the lower member 96 is engaged with the upper member 94 by pressing the lower member 96 into the opening in the bottom surface of the upper member 94 to cause the lips 126 to slide along the ramps 124 and pass completely over the ramps 124. The apparatus 84 is thus ready for use for retaining objects, for enabling sorting of objects such as papers and documents, and for enabling browsing of objects such as file folders.

The various bases and dividers described above can each be made of various materials, such as aluminum, wood and plastic, so that various combinations of materials are possible.

It should be clear that various modifications and alterations can be made within the scope of the present invention. None of the features or individual components of the apparatus described above are essential to any single embodiment and each feature can be substituted for by an equivalent structure. For example, the base shown in FIGS. 9A-10 may be used independent of the dividers shown therein, i.e., with different dividers, and the dividers shown therein may be used with other bases. Also, various features of one embodiment can be combined with features of other embodiments, consistent with proper operation thereof, within the scope of the present invention. All of the embodiments can be assembled by pressing the dividers down through the slots and into the cavity (ies), when the materials have sufficient resiliency or elasticity.

I claim:

1. A multi-section retaining/sorting/browsing apparatus, comprising:

a base including an upper member, a lower member and a plurality of parallel slots; and a plurality of dividers each arranged in connection with a respective one of said slots on said base, said dividers defining object-retaining sections between adjacent ones of said dividers, each of said dividers having a pair of separated anchor portions and an object support portion coupled to said anchor portions and extending through said respective one of said slots to provide a support for retaining objects, said anchor portions being rotatably retained in connection with said base to enable said dividers to be flipped forward and backward in a longitudinal direction, said anchor portions being partially retained between said upper and lower members of said base, said upper member including a top wall defining an opening through which said object support portions of said dividers extend and longitudinally extending flanges projecting downward from said top wall alongside said opening, said longitudinally extending flanges defining end walls of said slots, each of said end walls including a curved indentation, and a respective one of said anchor portions passing through each of said curved indentations to be situated below an overlying portion of said top wall.

2. The apparatus of claim 1, wherein each of said anchor portions of each of said dividers includes a projection extending outwardly to a position below the overlying portion of said top wall of said upper member of said base.

3. The apparatus of claim 2, wherein said projections are supported and rotate on bearing surfaces defined by said base.

4. The apparatus of claim 3, wherein said base defines additional bearing surfaces arranged relative to said projections such that each of said projections is situated between one of said bearing surfaces and one of said additional bearing surfaces.

5. The apparatus of claim 4, wherein said bearing surfaces are defined by said upper member and said additional bearing surfaces are defined by said lower member.

6. The apparatus of claim 2, wherein said projections have an X-shaped cross-section.

7. The apparatus of claim 1, wherein said lower member includes a substantially planar portion and a plurality of support projections arranged on an upper surface of said planar portion, said support projections defining bearing surfaces on which said anchor portions are supported and rotate.

8. The apparatus of claim 7, wherein said lower member further includes a plurality of transversely extending elevated sections arranged on said upper surface of said planar portion, each of said elevated sections including a horizontal wall raised above said planar portion, said horizontal walls partitioning said opening defined by said top wall into slots and limiting the flipping of said dividers in the longitudinal direction.

9. The apparatus of claim 1, wherein said anchor portions are partially retained between said upper and lower members, further comprising connecting means for connecting said upper member and said lower member together.

10. The apparatus of claim 9, wherein said lower member includes a substantially planar portion and a plurality of transversely extending elevated sections arranged on an upper surface of said planar portion, each of said elevated sections including a horizontal wall raised above said planar portion, said connecting means comprising ramps extending inward from said flanges and lips extending downward from transverse ends of said horizontal walls of said elevated sections whereby when said base is assembled, said lips are urged along angled surface of said ramps to pass over said ramps and thereby connect said upper member and said lower member together.

11. The apparatus of claim 1, wherein each of said dividers has an opening extending from a bottom edge of said dividers and situated between said anchor portions.

12. The apparatus of claim 1, wherein base includes at least one elongate, transversely extending receptacle alongside said dividers.

13. A multi-section retaining/sorting/browsing apparatus, comprising:

an elongate base including an upper member and a lower member and defining a plurality of parallel slots extending in a transverse direction, said upper member including a top wall defining an opening and longitudinally extending flanges projecting downward from said top wall alongside said opening, said longitudinally extending flanges defining end walls of said slots; and a plurality of dividers each arranged in connection with a respective one of said slots of said base, each of said dividers having an object support portion extending through said opening in said top wall of said upper member of said base to provide a support for retaining objects such that said dividers define object-retaining sections between adjacent ones of said dividers, part of said object support portion of each of said dividers having a larger dimension in a transverse direction of said base than said opening, said dividers being rotatably retained in connection with said base to enable said dividers to be flipped forward and backward in a longitudinal direction.

14. The apparatus of claim 13, wherein each of said dividers has a pair of separated anchor portions coupled to said object support portion, said anchor portions being rotatably retained between said upper and lower members.

15. The apparatus of claim 14, wherein said end walls of said slots each include a curved indentation, a respective one of said anchor portions passing through each of said curved indentations to be situated below an overlying portion of said top wall.

16. The apparatus of claim 14, wherein each of said anchor portions of each of said dividers includes a projection extending outwardly to a position below an overlying portion of said top wall, said projections being supported and rotating on bearing surfaces defined by said lower member.

17. The apparatus of claim 16, wherein said lower member includes a substantially planar portion and a plurality of support projections arranged on an upper surface of said planar portion, said support projections defining said bearing surfaces of said lower member on which said anchor portions are supported and rotate.

18. The apparatus of claim 17, wherein said lower member further includes a plurality of transversely extending elevated sections arranged on said upper surface of said planar portion, each of said elevated sections including a horizontal wall raised above said planar portion, said horizontal walls partitioning said opening defined by said top wall into said slots and limiting the flipping of said dividers in the longitudinal direction.

19. The apparatus of claim 13, wherein said lower member includes a substantially planar portion and a plurality of transversely extending elevated sections arranged on an upper surface of said planar portion, each of said elevated sections including a horizontal wall raised above said planar portion, further comprising connecting means for connecting said upper member and said lower member together, said connecting means comprising ramps extending inward from said flanges of said upper member and lips extending downward from transverse ends of said horizontal walls of said elevated sections on said lower member.

20. A multi-section retaining/sorting/browsing apparatus, comprising:

a base including an upper member, a lower member and a plurality of parallel slots, said upper member including a top wall defining an opening and longitudinally extending flanges projecting downward from said top wall alongside said opening, said lower member including a substantially planar portion and a plurality of transversely extending elevated sections arranged on an upper surface of said planar portion, each of said elevated sections including a horizontal wall raised above said planar portion;

a plurality of dividers each arranged in connection with a respective one of said slots on said base, said dividers defining object-retaining sections between adjacent ones of said dividers, each of said dividers having a pair of separated anchor portions and an object support portion coupled to said anchor portions and extending through said respective one of said slots to provide a support for retaining objects, said anchor portions being rotatably retained in connection with said base to enable said dividers to be flipped forward and backward in a longitudinal direction, said anchor portions being partially retained between said upper and lower members of said base; and connecting means for connecting said upper member and said lower member together, said connecting means comprising ramps extending inward from said flanges and lips extending downward from transverse ends of said horizontal walls of said elevated sections whereby when said base is assembled, said lips are urged along angled surface of said ramps to pass over said ramps and thereby connect said upper member and said lower member together.

* * * * *